US009819091B2

(12) United States Patent
Fan et al.

(10) Patent No.: US 9,819,091 B2
(45) Date of Patent: Nov. 14, 2017

(54) PORTABLE TERMINAL AND SLOT ANTENNA THEREOF

(71) Applicant: Huawei Device Co., Ltd., Shenzhen, Guangdong (CN)

(72) Inventors: Yi Fan, Shenzhen (CN); Yao Lan, Shenzhen (CN)

(73) Assignee: Huawei Device (Dongguan) Co., Ltd., Dongguan (CN)

( * ) Notice: Subject to any disclaimer, the term of this patent is extended or adjusted under 35 U.S.C. 154(b) by 443 days.

(21) Appl. No.: 14/134,894

(22) Filed: Dec. 19, 2013

(65) Prior Publication Data

US 2014/0104126 A1 Apr. 17, 2014

Related U.S. Application Data

(63) Continuation of application No. PCT/CN2013/077400, filed on Jun. 18, 2013.

(30) Foreign Application Priority Data

Jun. 21, 2012 (CN) ..... 2012 1 0208421

(51) Int. Cl.

| | |
|---|---|
| ***H01Q 13/10*** | (2006.01) |
| ***H01Q 1/24*** | (2006.01) |
| ***H01Q 1/48*** | (2006.01) |
| ***H01Q 5/385*** | (2015.01) |

(52) U.S. Cl.

CPC ..... *H01Q 13/10* (2013.01); *H01Q 1/243* (2013.01); *H01Q 1/48* (2013.01); *H01Q 5/385* (2015.01)

(58) Field of Classification Search

CPC ..... H01Q 13/10; H01Q 5/385; H01Q 1/48; H01Q 1/243

USPC ..... 343/702, 767

See application file for complete search history.

(56) References Cited

U.S. PATENT DOCUMENTS

| | | | | |
|---|---|---|---|---|
| 5,914,693 | A * | 6/1999 | Takei et al. | 343/767 |
| 6,653,977 | B1 * | 11/2003 | Okabe et al. | 343/700 MS |
| 6,664,931 | B1 * | 12/2003 | Nguyen | H01Q 1/243 343/700 MS |
| 6,956,531 | B2 * | 10/2005 | Sugiyama | H01Q 1/243 343/702 |

(Continued)

FOREIGN PATENT DOCUMENTS

| | | |
|---|---|---|
| CN | 2899139 Y | 5/2007 |
| CN | 101385197 A | 3/2009 |

(Continued)

*Primary Examiner* — Linh Nguyen

(74) *Attorney, Agent, or Firm* — Leydig, Voit & Mayer, Ltd.

(57) ABSTRACT

Embodiments of the present invention disclose a portable terminal and a slot antenna thereof, and relate to the field of mobile communications technologies, which can effectively reduce a space occupied by the antenna and at the same time meet various bandwidth requirements. The slot antenna of the portable terminal includes: a large-area conductor plane laid on a printed circuit board, a battery with a bulk conductor, and a first feeding part, where a slot is formed between the conductor plane and the battery, the conductor plane is radio-frequency coupled to the bulk conductor in the battery through the slot, and the first feeding part is located in the slot. The present invention is applied in designing the antenna of the portable terminal.

16 Claims, 3 Drawing Sheets

(56) References Cited

U.S. PATENT DOCUMENTS

| | | | | |
|---|---|---|---|---|
| 2004/0127248 | A1* | 7/2004 | Lin | H01Q 1/22 455/550.1 |
| 2007/0139286 | A1 | 6/2007 | Navsariwala et al. | |
| 2008/0316115 | A1* | 12/2008 | Hill | H01Q 1/243 343/702 |
| 2009/0256766 | A1* | 10/2009 | Bury | H01Q 1/243 343/767 |
| 2009/0289858 | A1* | 11/2009 | Olsson | H01Q 1/243 343/702 |
| 2014/0091974 | A1* | 4/2014 | Desclos | H01Q 3/00 343/745 |

FOREIGN PATENT DOCUMENTS

| | | | |
|---|---|---|---|
| CN | 102738574 | A | 10/2012 |
| EP | 2618423 | A2 | 7/2013 |
| WO | WO 2006114477 | A1 | 11/2006 |

* cited by examiner

PORTABLE TERMINAL AND SLOT ANTENNA THEREOF

CROSS-REFERENCE TO RELATED APPLICATIONS

This application is a continuation of International Patent Application No. PCT/CN2013/077400, filed on Jun. 18, 2013, which claims priority to Chinese Patent Application No. 201210208421.4, filed with the Chinese Patent Office on Jun. 21, 2012, both of which are incorporated herein by reference in their entireties.

TECHNICAL FIELD

The present invention relates to the field of mobile communication devices, and in particular, to a portable terminal and a slot antenna thereof.

BACKGROUND

An antenna (Antenna) is a converter, which converts a travelling wave propagated on a transmission line to an electromagnetic wave propagated in an unbounded medium (generally a free space), or performs inverse conversion. Engineering systems, such as radio communication, broadcast, television, radar, navigation, electronic countermeasure, remote sense, and radio astronomy, which transmit information by using an electromagnetic wave, all rely on an antenna for working. In addition, in the case of transferring energy by using an electromagnetic wave, non-signal energy radiation also requires an antenna. Generally, an antenna has reversibility, that is, a same antenna not only may be used as a transmitting antenna, but also may be used as a receiving antenna.

With popularity of handheld terminals, an antenna technology is more and more widely applied in handheld terminals. Due to a trend of developing small, light, and thin handheld terminals, an effective space in an antenna area becomes smaller and smaller; moreover, as there are many communication systems nowadays, for example, requirements of frequency bands such as 2G, 3G, and 4G need to be met, a target bandwidth is high, so that it is relatively difficult to design an antenna.

SUMMARY

A technical problem to be solved by the present invention is to provide a portable terminal and a slot antenna thereof, which can effectively reduce a space occupied by the antenna and at the same time meet various bandwidth requirements.

To solve the foregoing technical problem, embodiments of the present invention adopt the following technical solutions:

A slot antenna of a portable terminal, including: a large-area conductor plane laid on a printed circuit board, a battery with a bulk conductor, and a first feeding part, where a slot is formed between the conductor plane and the battery, the conductor plane is radio-frequency coupled to the bulk conductor in the battery through the slot, and the first feeding part is located in the slot.

A portable terminal, including: a radio frequency circuit, a printed circuit board with a large-area conductor plane, and a battery compartment for accommodating a battery, where a slot is formed between the conductor plane and the battery compartment, a first feeding part is disposed in the slot, the first feeding part is connected through a radio frequency transmission line to the radio frequency circuit, and the slot enables the conductor plane to be radio-frequency coupled to the battery when the battery is placed in the battery compartment.

In a technical solution of this embodiment, a slot is formed between a battery of a portable terminal and a PCB with a large-area conductor plane, and a feeding part is disposed in the slot to form a slot antenna. The battery and the PCB jointly forming a "ground" structure of the slot antenna are necessary structures of the portable terminal, so that functions of the slot antenna can be implemented by only adding one extra first feeding part. Therefore, this solution effectively reduces the space occupied by the antenna; moreover, through changes of the first feeding part, performance of the slot antenna can meet requirements of various communication frequency bands.

BRIEF DESCRIPTION OF DRAWINGS

To describe the technical solutions in the embodiments of the present invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

Figure 1:
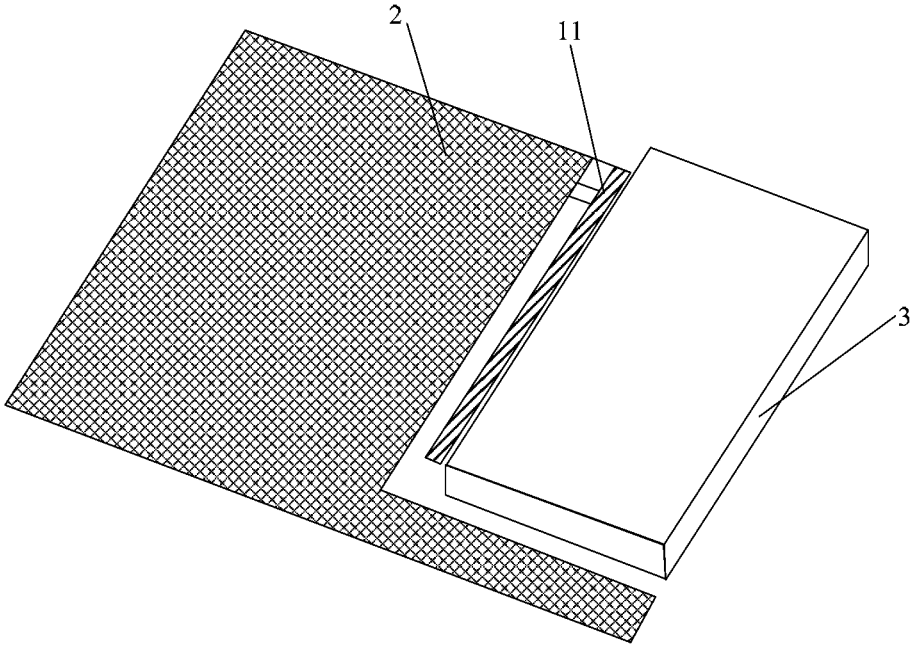
FIG. 1 is a first schematic structural diagram of a slot antenna of a portable terminal according to an embodiment of the present invention.

Reference numerals are described as follows:

| | | |
|---|---|---|
| 11—First feeding part; | 12—Second feeding part; | 2—PCB; |
| 21—Metal part; | 3—Battery; | 31—Auxiliary radiation part; |
| 4—Radio frequency circuit; | 5—Battery compartment. | |

DESCRIPTION OF EMBODIMENTS

The following clearly describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

Embodiments of the present invention provide a portable terminal and a slot antenna thereof, which can reduce a space occupied by the antenna and at the same time meet various bandwidth requirements.

An embodiment of the present invention provides a slot antenna of a portable terminal. As shown in FIG. 1, the slot antenna includes: a large-area conductor plane laid on a printed circuit board (Printed Circuit Board, PCB for short) 2, a battery 3 with a bulk conductor, and a first feeding part 11, where a slot is formed between the conductor plane and the battery 3, the conductor plane is radio-frequency coupled to the bulk conductor in the battery through the slot, and the first feeding part 11 is located in the slot.

The slot antenna is formed by disposing the first feeding part 11 in the slot formed between the two large-area conductors. In a technical solution of this embodiment, the slot antenna of the portable terminal includes three portions: the first portion is the PCB 2 of the portable terminal, where the PCB 2 is a support of an electronic component, provides an electrical connection for the electronic component, and has the large-area conductor plane; the second portion is the battery 3 carried by the portable terminal; the third portion is the first feeding part 11 located in the slot formed between the battery 3 and the conductor plane. The battery 3 is a grounding conductive structure, so the battery 3 and the conductor plane of the PCB 2 jointly form a "ground" structure of the antenna. The slot antenna is designed by using the slot formed by the "ground" structure. Through changes of the first feeding part 11, performance of the antenna can meet requirements of various communication frequency bands. In addition, the battery and the PCB functioning as the two large-area conductors of the slot antenna are necessary structures of the portable terminal, so that functions of the slot antenna can be implemented by only adding one extra first feeding part. Therefore, this solution effectively reduces a space occupied by the antenna. A test shows that, only an extra clear space area of about 5 mm×40 mm needs to be added.

The large-area conductor plane of the PCB may be a ground plane (Ground Plane) or a power plane (Power Plane) of the PCB. Herein, the large-area conductor plane refers to a large-area conductor with good connectivity, for example, a large-area copper foil. Generally, in a multi-layer PCB, one layer is specially laid with the large-area conductor plane as a ground layer or a power layer.

The battery includes the bulk conductor. Generally, an inner core or an inner shell of the battery is made of metal. Taking a lithium-ion battery which is most commonly used at present as an example, the inner shell of the lithium-ion battery is generally a steel shell, an aluminum shell, or a nickel-plated iron shell. In addition, a layer of electrolytic copper foil of 7-15 microns thick is generally provided inside the lithium-ion battery as a current collector.

Figure 2:
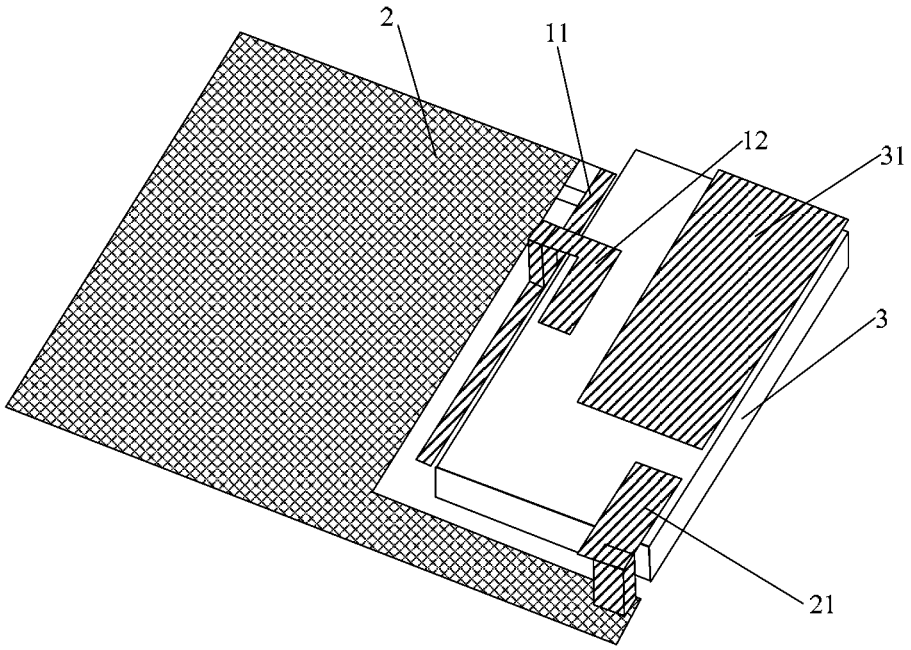
FIG. 2 is a second schematic structural diagram of a slot antenna of a portable terminal according to an embodiment of the present invention.

Optionally, as shown in FIG. 2, the feeding part includes: the first feeding part 11, which is of a strip shape.

Further, as shown in FIG. 2, the antenna may further includes: a second feeding part 12 connected to the first feeding part 11. The second feeding part 12 is bent, a vertical projection area of a bent portion of the second feeding part 12 is projected onto the battery 3, and the second feeding part 12 is radio-frequency coupled to the bulk conductor in the battery 3.

To increase a "ground" length, that is, to increase an effective radiation length of the slot antenna, and to increase a low-frequency bandwidth, further, a metal part 21 may be connected to the conductor plane of the PCB 2; moreover, further, to avoid an increase in an overall length or width of the entire system, the metal part 21 may be designed to be bent, and the bent portion of the second feeding part 12 and the battery 3 are located within the same vertical projection area, that is, the vertical projection area of the bent portion is located on the battery 3. In an embodiment, the metal part 21 is radio-frequency coupled to the bulk conductor in the battery 3.

Further, an auxiliary radiation part 31 may be suspended above the battery 3, where the auxiliary radiation part 31 is radio-frequency coupled to the bulk conductor in the battery 3. The auxiliary radiation part 31 is suspended above the battery 3, not only saving the space, but also further increasing an operating bandwidth of the antenna.

It needs to be noted that, the first feeding part 11 is connected through a radio frequency transmission line to a radio frequency circuit, where the radio frequency circuit may be printed on the PCB 2. The battery 3 may include: a battery case, a battery inner core, a battery inner protection circuit, and a battery structural part. The battery 3 includes a bulk conductor, a slot is formed between the battery 3 and the conductor plane of the PCB 2, and then a slot antenna provided by this solution is formed by using such a slot. Structures, specifications, and positions of the battery 3, the PCB 2, and the conductor plane are only examples in this embodiment, and may be set according to bandwidth requirements of a specific portable terminal, which are not limited in this embodiment.

Figure 3:
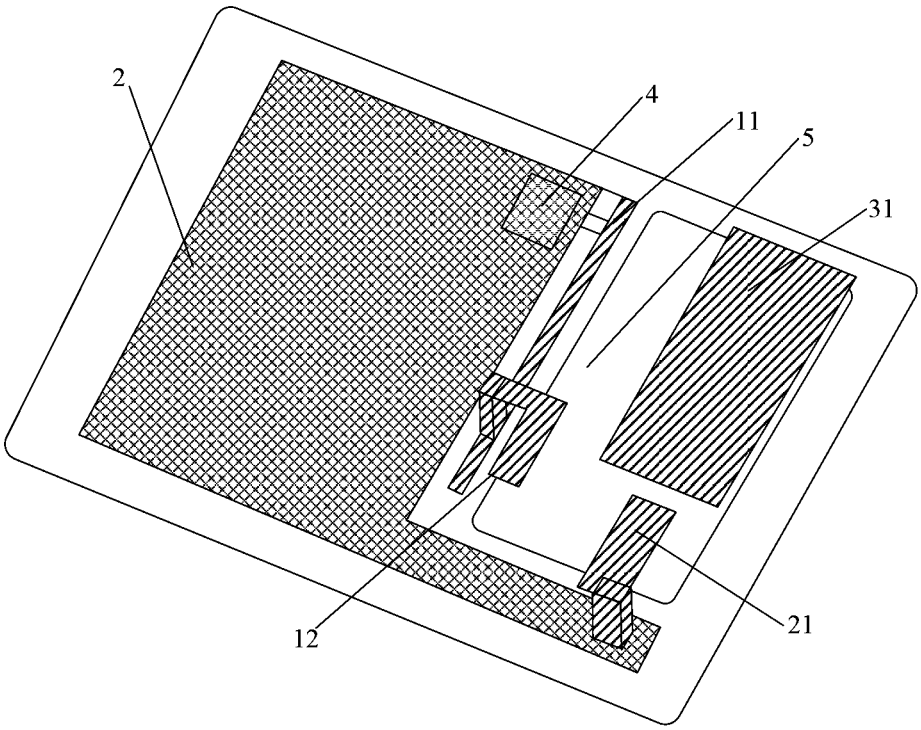
FIG. 3 is a schematic structural diagram of a portable terminal according to an embodiment of the present invention.

An embodiment of the present invention further provides a portable terminal. As shown in FIG. 3, the portable terminal includes: a radio frequency circuit 4, a PCB 2 with a large-area conductor plane, a battery compartment 5 for accommodating a battery, where a slot is formed between the conductor plane and the battery compartment 5, a first feeding part 11 of an antenna is disposed in the slot, and the first feeding part 11 is connected through a radio frequency transmission line to the radio frequency circuit 4. The slot enables the conductor plane to be radio-frequency coupled to a battery 3 when the battery 3 is placed in the battery compartment 5.

When the portable terminal is used, the battery is placed in the battery compartment 5, and the PCB 2 with the large-area conductor plane, the battery, and the first feeding part 11 form the slot antenna of the portable terminal. Reference is made to the foregoing embodiment for a specific structure of the slot antenna of the portable terminal, and details are not repeated herein. A vertical projection area of a bent portion of a second feeding part 12 and that of a bent portion of a metal part 21 connected to the conductor plane of the PCB 2 are both projected onto the battery compartment. An auxiliary radiation part 31 is suspended above the battery compartment, so as to save the space.

The portable terminal may further include: a second feeding part 21 connected to the first feeding part 11, where the second feeding part 21 is bent, and a vertical projection area of the bent portion of the second feeding part 21 is projected onto the battery compartment 5. When the battery with a bulk conductor is placed in the battery compartment 5, the second feeding part 21 is radio-frequency coupled to the bulk conductor in the battery.

An auxiliary radiation part 31 may be suspended above the battery compartment 5. When the battery with the bulk conductor is placed in the battery compartment 5, the auxiliary radiation part 31 is radio-frequency coupled to the bulk conductor in the battery.

The conductor plane may be a ground plane or a power plane on the printed circuit board.

In the technical solution of this embodiment, a slot is formed between a battery of a portable terminal and a PCB with a large-area conductor plane, and a feeding part is disposed in the slot to form a slot antenna. The battery and the PCB jointly forming a "ground" structure of the slot antenna are necessary structures of the portable terminal, so that functions of the slot antenna can be implemented by only adding one extra first feeding part. Therefore, this solution effectively reduces the space occupied by the antenna; moreover, through changes of the first feeding part, performance of the slot antenna can meet requirements of various communication frequency bands.

The foregoing descriptions are merely specific embodiments of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A slot antenna of a portable terminal, comprising: a conductor plane on a printed circuit board, a battery with a conductor in the battery, and a first feeding part, wherein a slot exists between the conductor plane and the battery, the conductor plane is radio-frequency coupled to the conductor in the battery through the slot, and the first feeding part is located in the slot; wherein the conductor plane is connected to a metal part, a vertical projection area of a bent portion of the metal part is located on the battery, the bent portion of the metal part is on a plane above the conductor plane and the battery, and the metal part is radio-frequency coupled to the conductor in the battery.

2. The slot antenna according to claim 1, wherein the first feeding part is of a strip shape.

3. The slot antenna according to claim 1, further comprising: a second feeding part connected to the first feeding part, wherein a vertical projection area of a bent portion of the second feeding part is projected onto the battery, and the second feeding part is radio-frequency coupled to the conductor in the battery.

4. The slot antenna according to claim 2, further comprising: a second feeding part connected to the first feeding part, wherein a vertical projection area of a bent portion of the second feeding part is projected onto the battery, and the second feeding part is radio-frequency coupled to the conductor in the battery.

5. The slot antenna according to claim 1, wherein an auxiliary radiation part is suspended above the battery, and the auxiliary radiation part is radio-frequency coupled to the conductor in the battery.

6. The slot antenna according to claim 1, wherein the conductor plane is a ground plane or a power plane on the printed circuit board.

7. A portable terminal, comprising: a radio frequency circuit, a printed circuit board with a conductor plane, and a battery compartment for accommodating a battery, wherein a slot is formed between the conductor plane and the conductor of the battery compartment, a first feeding part is disposed in the slot, the first feeding part is connected through a radio frequency transmission line to the radio frequency circuit, and the slot enables the conductor plane to be radio-frequency coupled to a conductor in the battery when the battery with the conductor is present in the battery compartment; wherein, the conductor plane is connected to a metal part, a vertical projection area of a bent portion of the metal part is located on the battery compartment, the bent portion of the metal part is on a plane above the conductor plane and the battery, and when the battery with the conductor is placed in the battery compartment, the metal part is radio-frequency coupled to the conductor in the battery.

8. The portable terminal according to claim 7, wherein the first feeding part is of a strip shape.

9. The portable terminal according to claim 7, further comprising: a second feeding part connected to the first feeding part, wherein a vertical projection area of a bent portion of the second feeding part is projected onto the battery compartment, and when the battery with the conductor is placed in the battery compartment, the second feeding part is radio-frequency coupled to the conductor in the battery.

10. The portable terminal according to claim 7, further comprising: a second feeding part connected to the first feeding part, wherein vertical projection area of a bent portion of the second feeding part is projected onto the battery compartment, and when the battery with the conductor is present in the battery compartment, the second feeding part is radio-frequency coupled to the conductor in the battery.

11. The portable terminal according to claim 7, further comprising: a second feeding part connected to the first feeding part, wherein a vertical projection area of a bent portion of the second feeding part is projected onto the battery compartment, and when the battery with the conductor is present in the battery compartment, the second feeding part is radio-frequency coupled to the conductor in the battery.

12. The portable terminal according to claim 7, characterized by further including an auxiliary radiation part suspended above the battery compartment, wherein when the battery with the conductor is present in the battery compartment, the auxiliary radiation part is radio-frequency coupled to the conductor in the battery.

13. The portable terminal according to claim 7, wherein an auxiliary radiation part is suspended above the battery compartment, and when the battery with the conductor is present in the battery compartment, the auxiliary radiation part is radio-frequency coupled to the conductor in the battery.

14. The portable terminal according to claim 7, wherein the conductor plane is a ground plane or a power plane on the printed circuit board.

15. The slot antenna according to claim 1, wherein the conductor plane is a large-area conductor plane and wherein the conductor in the battery is a bulk conductor.

16. The slot antenna according to claim 1, wherein the conductor in the battery comprises a metal inner core or a metal inner shell of the battery.

* * * * *